United States Patent [19]

Pickerrell et al.

[11] Patent Number: 5,054,133

[45] Date of Patent: Oct. 8, 1991

[54] LOW WATER CONSUMPTION TOILET FIXTURE

[75] Inventors: Daniel A. Pickerrell, Fishers; Donald C. Schrock, Carmel; John Inch, Indianapolis, all of Ind.

[73] Assignee: Masco Corporatiopn of Indiana, Taylor, Mich.

[21] Appl. No.: 343,751

[22] Filed: Apr. 26, 1989

[51] Int. Cl.[5] ..... E03D 11/18

[52] U.S. Cl. ..... 4/428; 4/425; 4/329

[58] Field of Search ..... 4/420, 421, 428, 425, 4/329, 300, 430, 422, 423

[56] References Cited

U.S. PATENT DOCUMENTS

| | | | |
|---|---|---|---|
| 229,326 | 6/1880 | Maddock | 4/420 |
| 622,205 | 4/1899 | Burnett | 4/424 |
| 685,621 | 10/1901 | Maddock | 4/425 |
| 1,224,734 | 5/1917 | Gallagher | 4/330 |
| 1,419,328 | 6/1922 | Teahen et al. | 4/329 |
| 1,947,439 | 2/1934 | Crane etal. | 4/425 |
| 2,075,030 | 3/1937 | Duncan, Jr. | 4/425 |
| 2,121,940 | 6/1938 | Wolff | 4/428 |
| 3,086,217 | 4/1963 | Barlow | 4/425 |
| 3,131,402 | 5/1964 | Roberts | 4/344 |
| 3,212,106 | 10/1965 | Noel | 4/421 |
| 3,591,868 | 7/1971 | Owens | 4/300 |
| 3,614,793 | 10/1971 | Nemiroff | 4/580 |
| 3,719,209 | 3/1973 | Rush | 138/177 |
| 3,816,234 | 6/1974 | Winfield | 4/234 |
| 3,843,978 | 10/1974 | Ragot | 4/425 |
| 3,860,973 | 1/1975 | Uyeda et al. | 4/332 |
| 3,932,901 | 1/1976 | Inui et al. | 4/332 |
| 3,939,500 | 2/1976 | Miller et al. | 4/332 |
| 4,145,772 | 3/1979 | Whitney et al. | 4/300 |
| 4,145,776 | 3/1979 | Crosby et al. | 4/425 |

FOREIGN PATENT DOCUMENTS

| | | | |
|---|---|---|---|
| 824073 | 9/1969 | Canada . | |
| 994502 | 8/1976 | Canada . | |
| 1166321 | 11/1958 | France | 4/425 |
| 9226 | of 1911 | United Kingdom | 4/420 |
| 685960 | 1/1953 | United Kingdom . | |

*Primary Examiner*—Henry J. Recla
*Assistant Examiner*—Glenn T. Barrett
*Attorney, Agent, or Firm*—Myron B. Kapustij; Edgar A. Zarins; Malcolm L. Sutherland

[57] ABSTRACT

A low consumption toilet fixture (10) has a bowl (20), a tank (16) having a central exit (43), a waterway passage extending from the tank to the bowl (20) and an angled trap (22) that has a bottom well (24). The downstream end (34) of the trap (22), inlet (42) of the waterway, and well (24) all bisect a central vertical reference plane which divides the toilet into two halves. The angled trap has an intermediate upper section (30) which is laterally offset with respect to the inlet (42) of the waterway (21) and has a height greater than a lower wall (50) of the horizontal leg (44) of the waterway that extends from the central inlet (42). The waterway (22) has an exit opening into the well (24). The exit has an upper groove (49) and notch (51) directing water into the bottom of bowl (20). The well (24) is canted laterally and forwardly downwardly with respect to the central vertical reference plane.

7 Claims, 3 Drawing Sheets

FIG. 3.
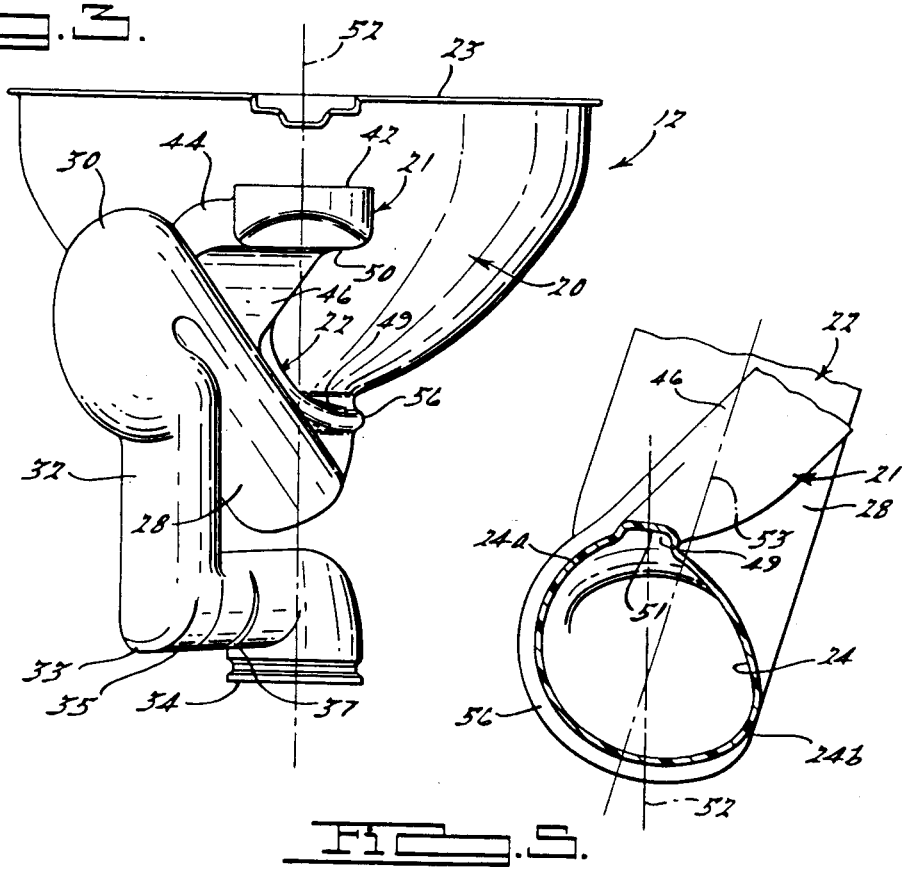
FIG. 5.
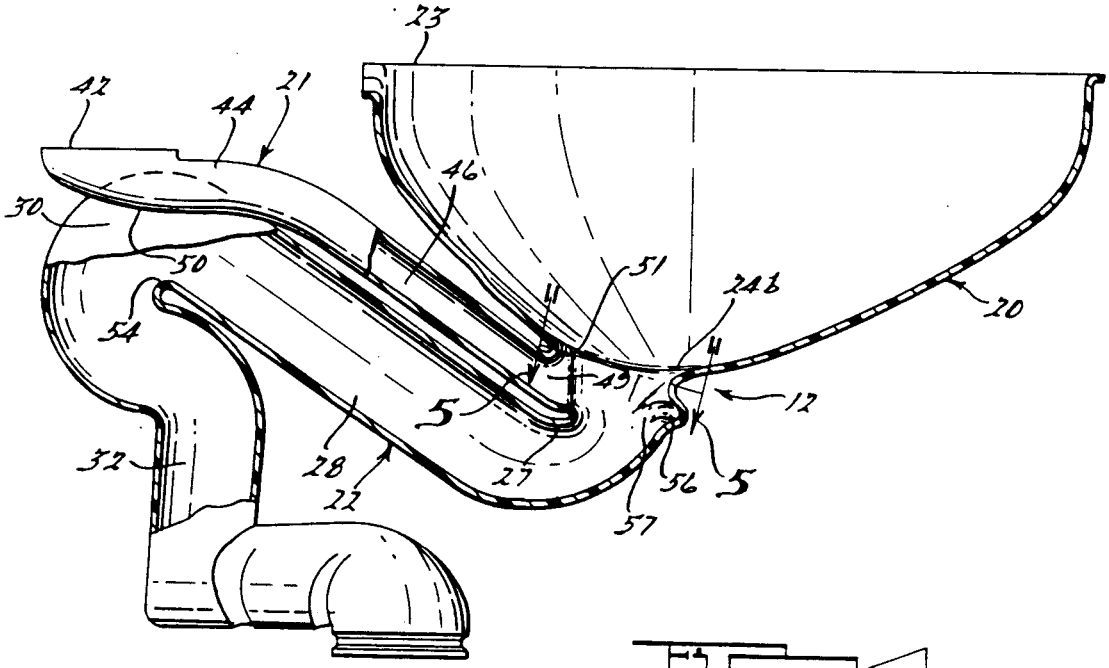
FIG. 4.

LOW WATER CONSUMPTION TOILET FIXTURE

TECHNICAL FIELD

The present invention relates generally to a low water consumption toilet fixture and more particularly to the bowl, waterway and trap construction for such a toilet fixture.

DISCLOSURE INFORMATION

Water closets, now commonly referred to as toilet fixtures, have been designed to provide adequate flushing so that only clean water remains in the toilet bowl and siphonic trap. Adequate flushing has long been provided by a sufficient amount of water and adequate pressure. In old toilet designs, a single flush could consume more than six gallons of water and the pressure was often supplied by a tank located more than six feet above the toilet bowl. With the advent of low profile toilet designs, the tank located six feet above the bowl became unacceptable. The low profile one-piece designs have been commonly available for more than fifty years. The common low profile toilet needed much water for an adequate flush to compensate for the lesser pressure available from the low positioned tank.

With the advent of more carefully designed and engineered toilets, the amount of water needed to provide an adequate flush has been reduced. Designs for toilets have called for materials other than ceramics. A toilet made from plastic can provide more consistent clean flushes due to the closer tolerances provided during the manufacturing molding techniques of plastic as compared to the conventional ceramic manufacturing techniques. Furthermore, toilets made from plastic can have a one-piece homogeneously formed bowl, waterway and siphonic trap without seams. Production toilets having flushes using only three and one-half (3½) gallons have been marketed.

However, the need for low water consumption toilets is ever increasing. Clean water needs to be conserved. The water volume sent to sewage filtration plants needs to be reduced. Thirdly, many septic fields have been taxed to their capacity and waste water from homes using septic tanks needs to be reduced.

Various attempts for low water usage toilet fixtures in combination with the popular low profile one-piece design have been devised. Some toilets incorporate air pressure systems in the tank to provide adequate water pressure or provides an air flush chamber in place of a trap. These toilets are complicated in that they need either sealed chambers or air compressors with the accompanying electric circuitry.

The need to increase the water pressure, i.e. waterhead, is most easily accomplished by having a higher profile toilet. However, a higher tank is often aesthetically undesirable. The popularity of the low profile one-piece designs in the market place dictates that a low water consumption toilet to be commercially acceptable must also have a low profile design. The low profile one-piece design also is coupled with package constraints where the waterway between the tank, bowl and siphonic trap are placed one on top of the other. The package constraints for the trap are further complicated by many local code requirements that the weir of the trap (or dam) must be at least two inches above the trap dip of the toilet bowl to prevent possible sewer gas backup.

Standard low profile one-piece toilets have been carefully packaged to properly position the trap and the waterway. Low water consumption toilets have further packaging problems. A longer siphon leg is desired to provide stronger flushing performance for the lesser amount of water used. The siphon leg is most easily lengthened by raising the bowl bottom. However, the higher position of the bowl dictates that the weir of the trap be correspondingly raised because the weir of the trap must still be at least two inches higher than the trap dip of the bowl to create a sufficient trap to prevent sewer gas from entering the bowl. However, raising the siphon leg causes interference with the waterway. One solution has been to offset the waterway, i.e. jet way. However, offsetting of the jet way requires an eccentrically placed tank exit which requires the use of nonstandard or specialized flush valve linkages and flush valve to compensate for the nonstandard position of the tank exit.

What is needed is a one-piece molded bowl, jet way and trap that is packaged to retain the clearance requirements of the siphonic leg and is still usable with a standard center outlet tank for use with a low water consumption toilet fixture to provide an adequate flush cycle.

SUMMARY OF THE DISCLOSURE

In accordance with one aspect of the invention, a toilet fixture includes a bowl having a large top opening and a small discharge opening in its bottom end leading into a siphonic trap. The siphonic trap includes the discharge opening forming an upstream end of the trap and a downstream end for connection with a drain pipe. A waterway for supplying water from a tank to the bowl slopes downwardly from an upper inlet that is connectable to a tank to a lower exit communicating with the bowl. The upper inlet of the waterway, a discharge opening (commonly referred to as a well) and, preferably, the downstream end of the trap intersects a central vertical longitudinal reference plane bisecting the bowl into two similar but mirrored halves. The trap is angled with respect to the vertical longitudinal reference plane.

Preferably the trap has an intermediate high point that is laterally displaced from the upper inlet of the waterway with respect to the vertical longitudinal reference plane and has a vertical height equal to the height of the waterway.

In accordance with another aspect of the invention, a toilet fixture includes a bowl, a trap and a waterway extending from an inlet end to a downstream outlet in proximity to a discharge opening of the bowl. The inlet and downstream portion of the waterway are substantially centered with respect to the central vertical reference plane with an intermediate portion angled and bent so that water enters the bowl from the waterway exit at an angle with respect to the reference plane. A semi-annular groove at said discharge opening then directs the water into a vortex with the end of the groove aligned with the angle of the trap to direct water into the siphonic trap.

Another aspect of the invention relates to a unique and novel discharge opening that is canted downwardly, not only forward but also to one side of the central vertical longitudinal reference plane. The lowest point of the bowl is not only laterally displaced from the central longitudinal reference plane but also is asymmetrically positioned relative to the longitudinal axis of the trap and is vertically aligned over the downstream end of the semi-annular groove about the discharge opening. The downstream end of the semi-annular groove is bent downwardly and smoothly blends in with the lowest point of the bowl to provide an efficient passage of liquid from the bowl through the well and up into the trap.

A groove longitudinally extends on the upper portion of the downstream end of the jet way forming a notch at the discharge passageway. The groove and notch directs water to the bottom of the bowl above the discharge opening.

In accordance with another aspect of the invention, the waterway has a downstream portion angled with respect to the reference plane so that the water enters the bowl from the waterway exit at an angle thereof.

Preferably the bowl, waterway, and trap are formed homogeneously and integrally from a single integral piece of plastic which is impervious to water.

In this fashion, a low water consumption toilet fixture can be achieved by raising the bowl bottom and still provide an upleg of a trap with a two inch rise above the trap dip in the well below the bowl. The angled trap allows the high point of the trap to be laterally offset with respect to the inlet end of the waterway so that it can be raised as high as the waterway. Furthermore, the trap and waterway provide better flow characteristics and hence a successful flush can be provided with the use of less water.

The waterway has its inlet centrally located along the central vertical longitudinal reference plane so that the tank that connects to the inlet can have the standard center exit and be provided with a standard fill valve, flush valve, handle and linkages.

The offsetting or asymmetric position of the low point of the bowl in conjunction with its alignment over the downwardly bent downstream end of the semi-annular groove about the discharge opening provides for an efficient transfer of the energy provided by the water exiting the waterway to the siphonic trap. Acceptable flushes can be accomplished with as little as 1.6 gallons of water.

BRIEF DESCRIPTION OF THE DRAWINGS

Reference now will be made to the following drawings in which:

FIG. 3 is a rear elevational view of the unitary bowl waterway and trap member;

FIG. 4 is a left side elevational and partially segmented view of the unitary bowl, waterway and trap member;

FIG. 5 is an enlarged fragmentary and cross-sectional view taken along the lines 5—5 shown in FIG. 4;

DETAILED DESCRIPTION OF THE PREFERRED EMBODIMENT

Figure 1:
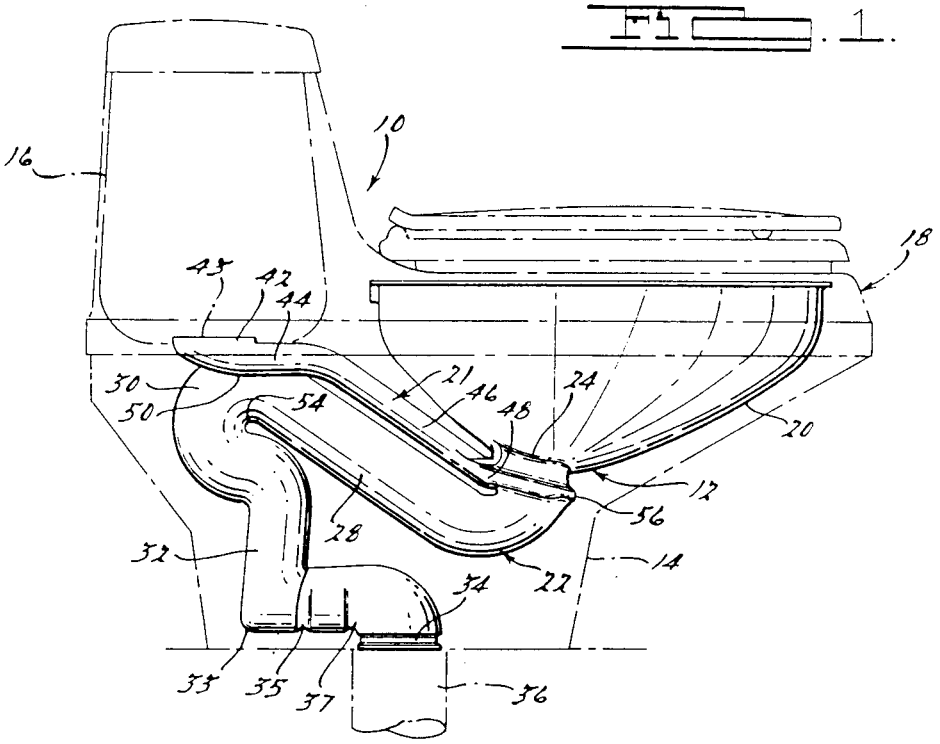
FIG. 1 is a left side elevational view of a unitary bowl, waterway, and trap member shown installed in a toilet fixture with the tank, tank cover, upper housing and lower, housing shown in phantom.

A toilet fixture 10 shown in FIG. 1 has a unitary bowl, waterway and trap member 12 placed in the lower housing 14. The tank 16 is formed in an upper housing 18 which is mounted on top of the lower housing 14. The assembly of the toilet fixture is taught in U.S. Pat. No. 4,145,772 issued March 27, 1979 to Thomas M. Whitney, William F. Price and Samuel C. Crosby and is incorporated herein by reference, particularly the Detailed Description of the Preferred Embodiment and the accompanying drawings.

The unitary bowl, waterway and trap member 12 shown in FIGS. 2, 3, 4, 6 and 7 has a bowl 20, a waterway 21 and a trap 22. The trap 22 is angled with respect to a center vertical reference plane 52 bisecting the toilet into two halves. As shown, the trap 22 is angled to follow axis line 53. The trap 22, by being angled, has a top section 30 laterally offset with respect to the waterway 21.

Figure 2:
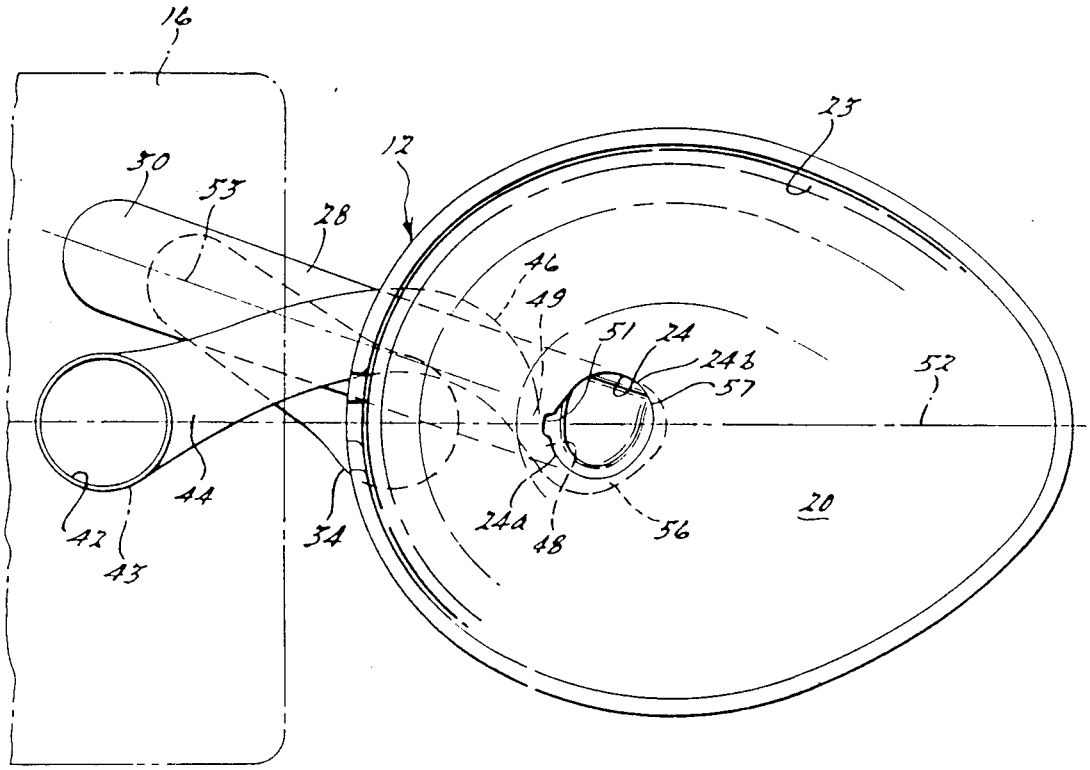
FIG. 2 is a top plan view of the unitary bowl, waterway and trap member with the tank shown in position in phantom.
Figure 6:
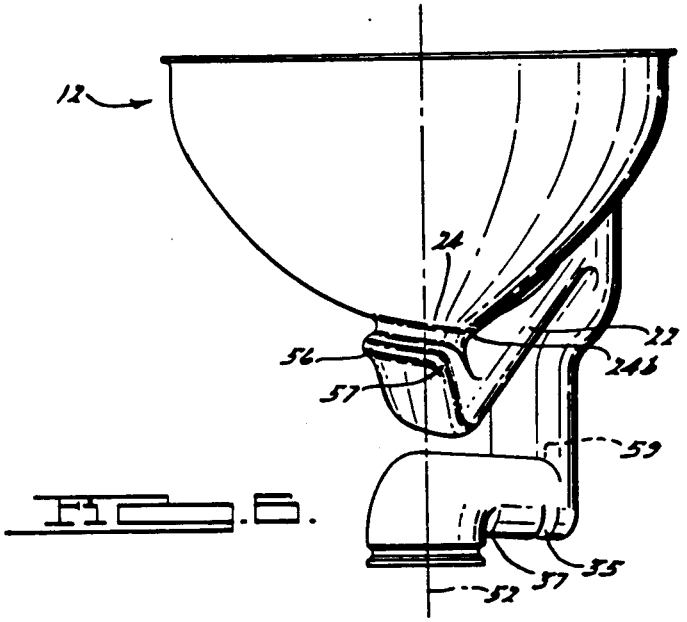
FIG. 6 is a front elevational view of the unitary bowl, waterway and trap member.
Figure 7:
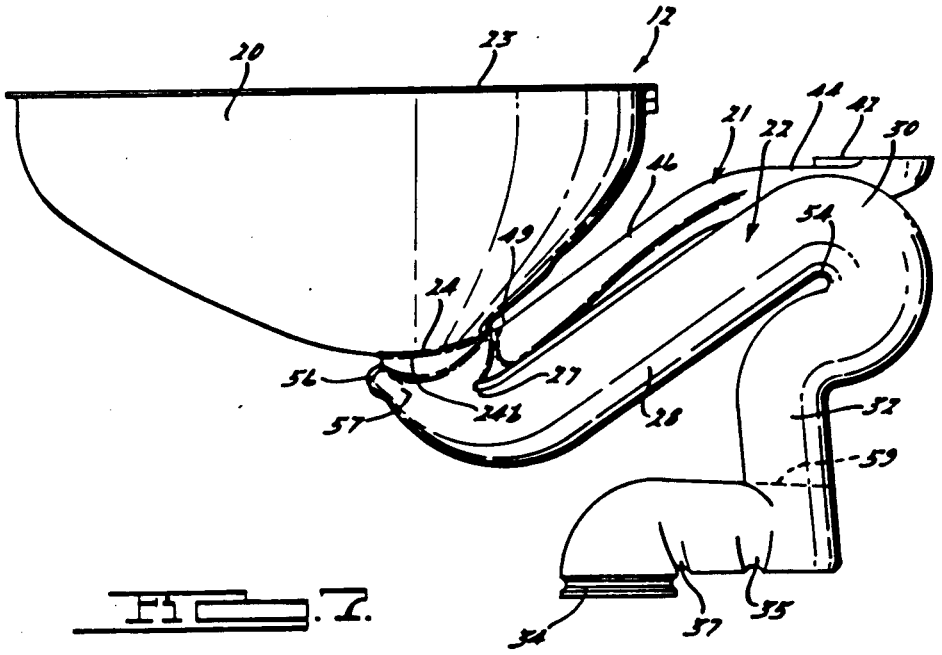
FIG. 7 is a right side elevational view of the unitary bowl, waterway and trap member.

In particular, the bowl 20 has a large upper opening 23 and a small discharge opening 24, commonly referred to as well, at its bottom. The discharge opening 24 forms the upper end of and communicates with the trap 22. The well or discharge opening 24 shown clearly in FIG. 5 is canted downwardly in a forwardly and laterally direction such that its high point is located at 24*a* and its low point is located at 24*b*. The high and low points 24*a* and 24*b* are laterally offset from reference plane 52. The low point 24*b* of discharge opening is also referred to as the low point of the bowl 20. The low point 24*b* of bowl 20 is substantially transversely displaced from the axis 53 of angled trap 22. The well 24 can be viewed being a substantially planar opening but tilted about axis 53 from the horizontal flat position. The asymmetric side placement of the low point 24*b* with respect to the axis 53 and its alignment of point 24*b* over the downward bend 57 of groove 56 blended into the angled trap enhances the siphonic flushing capabilities of the unit. As shown in FIGS. 2 and 5, high point 24*a* and low point 24*b* are positioned on opposite lateral sizes planes 52.

The trap 22 has a lower break point (i.e. trap dip) 27, an upwardly extending leg 28, a weir 54, a curved intermediate high section 30 and a downward extending leg 32 with a downstream end 34 connectable to a drain pipe 36. The leg 32 has a sharp elbow 33 and two grooves 35 and 37 which form embossments in the leg 32 to slow down water flow to help form the siphon flush. The choke section 59 of the trap has the smallest cross-sectional opening. The height differential between choke section 59 and trap dip 27 determines in part the siphon strength of the trap 22.

The waterway 21 has an inlet 42 communicating with a central outlet 43 and horizontally extending leg 44, downwardly sloping leg 46 and an exit 48 at the discharge opening 24. The exit 48 is located at the high point 24*a* of the well 24. The exit 48 has an upper grooved extension 49 that forms a notch 51 near the high point 24*a* of well 24.

Referring now to FIGS. 2 and 3, trap 22 is angled with respect to the bisecting vertical plane 52. The longitudinal axis 53 of trap 22 forms an angle of about 17° with reference plane 52 as shown in FIG. 2. The plane 52 passes through the center of water inlet 42 and discharge opening 24. The intermediate high section 30 of trap 22 is offset with respect to the bisecting vertical plane 52. The plane 52 passes through the center of water inlet 42 and discharge opening 24. The intermediate high section 30 of trap 22 is laterally offset with respect to the horizontal leg portion 44 of the waterway 21 and has a vertical height equal to the height of portion 44 of the waterway 21 as clearly shown in Figs, 3 and 7. More particularly, the section 30 has a vertical height greater than the lower wall 50 of horizontal section 44.

The trap 22 angles back toward the central bisecting plane 52 downstream of the weir 54 so that the downstream end 34 also is bisected by the vertical reference plane 52.

Waterway 21 has its horizontal leg 44 also angled with respect to the bisecting plane 52 and has its sloping leg 46 positioned above the leg 28 of the trap 22. The leg 46 is angled with respect to the reference plane 52 and downstream exit 48 is bisected by the central plane 52. The exit 48 leads to a semi-annular groove 56 extending about a substantial portion of the discharge opening 24 and having its downstream end 57 bent downwardly and blending into the well 24. The downstream end 57 is vertically aligned with the low point 24*b* of bowl 20 and blends into trap leg 28 as clearly shown in FIG. 4. Water passes downward through the waterway 21 and through exit 48 and well 24. The water from waterway 21 enters the discharge opening 24 and bowl 20 at an angle initially directed away from the reference plane 52 and directed into a counterclockwise vortex pattern within groove 56. Water directed up through groove 49 enters the bottom portion of bowl 20 and instigates the vortex action of the water within bowl 20. A separate rim wash (not shown) in housing 18 directs water to the upper end 48 of bowl 20. As described, there are two distinct flow patterns; one exiting the opening 48 and entering groove 56 to create a vortex in well 24 and a second flow exiting notch 51 and into the bowl 20 to create a vortex flow therein. The vortex action and redirection of the water in the groove 57 enhances the siphonic action of the trap 22. Notch 51 extends vertically upwardly from a position adjacent to, and vertically lower than high point 24*a*, to a position vertically higher than high point 24*a*.

As shown in FIG. 1, the exit 48 is above the trap dip 27. The trap dip 27 must be positioned two inches below the weir 54 to prevent sewer gases from backing up through trap 22 and to meet various voluntary and required codes. The unitary bowl waterway and trap member 12 renders a number of advantages.

The angling of the trap 22 allows for the sufficient height differential between the trap dip 27 and the weir 54 in spite of the fact that trap dip 27 is higher compared to other conventional bowls. The height difference between trap dip 27 and choke point 59 is increased to create a stronger siphon. Sufficient cross-sectional area through intermediate upper section 30 is also provided due to the greater space available from the angling of trap 22. The enhanced cross-sectional area enables sufficient flow of the exiting water during a flush cycle. The sufficiently large cross-sectional area is accomplished by placing the section laterally offset with respect to the horizontal leg 44 of the waterway 21.

The asymmetric side placement of low point 24*b*, i.e. the tilting of well 24, enhances the siphonic action of the bowl, well and trap.

The angling of the trap 22 with respect to the plane 52 provides for the sufficient flow and code requirements without modification to the tank 16 that is connected to the inlet 42 of the waterway 21. The tank 16 by maintaining its central exit 43 can then be provided with a conventional flush valve, fill valve and the accompanying trip lever. The tank 16 can also be provided with the conventionally located supply inlet.

Thus by angling the trap 22, the inside bottom of the bowl 20 can be raised to provide for a longer siphonic downward leg 32 and still provide the code requirements for at least two inches clearance between the trap dip and the weir. The curved high end of the trap is large enough for adequate flow therethrough.

The waterway 21 by being angled and having a semi-annular groove 56 surrounding the discharge opening 24 provides for a counterclockwise vortex during flushing which further enhances the siphonic action through the angled trap. The upper groove 49 enhances the vortex action in the bowl 20.

Variations and modifications of the invention are contemplated without departing from its spirit as defined in the appended claims.

The embodiment in which an exclusive property or privilege is claimed is defined as follows:

1. A toilet fixture comprising:

a tank;

a trap having a discharge outlet at a downstream end for connection with a drain pipe;

a bowl positioned longitudinally forwardly of said tank, said bowl having a large top opening and a small well at a bottom position leading into said trap, a longitudinally and vertically extending plane which bisects said bowl being defined as a reference plane;

a waterway sloping downwardly from an upper inlet which is fluidly connected to said tank, to a lower exit entering said bowl near said well, said waterway supplying water from said tank to said bowl, from said lower exit;

said waterway having a notch at the upper portion of said lower exit for directing water into a bottom section of said bowl;

said upper inlet, said well and said discharge outlet all being intersected by said reference plane;

said trap being angled with respect to said reference plane; and said well being canted with respect to said reference plane vertically downwardly in a forward and lateral direction, such that distinct high and low points of said well are defined, said distinct high and low points being laterally spaced on opposite sides of said reference plane.

2. A toilet fixture comprising:

a tank;

a trap having a discharge outlet at a downstream end for connection with a drain pipe;

a bowl positioned longitudinally forwardly of said tank, said bowl having a large top opening and a small well at a bottom position leading into said trap, a longitudinally and vertically extending plane which bisects said bowl being defined as a reference plane;

a waterway sloping downwardly from an upper inlet which is fluidly connected to said tank, to a lower exit entering said bowl near said well, said waterway supplying water from said tank to said bowl, from said lower exit;

said waterway having an upwardly disposed groove forming a notch at the upper portion of said lower exit for directing water into the bottom section of said bowl;

said upper inlet, said well and said discharge outlet all being intersected by said reference plane;

said trap being angled with respect to said reference plane;

said well being canted with respect to said reference plane vertically downwardly in a forward and lateral direction, such that distinct high and low points of said well are defined, said distinct high and low points being laterally spaced on opposite sides of said reference plane; and said lower exit intersecting said reference plane, and directing water into said bowl laterally outwardly at an angle away from said reference plane, in a direction toward said high point.

3. A toilet fixture comprising:

a tank;

a trap having a discharge outlet at a downstream end for connection with a drain pipe;

a bowl positioned longitudinally forwardly of said tank, said bowl having a large top opening and a small well at a bottom position leading into said trap, a longitudinally and vertically extending plane which bisects said bowl being defined as a reference plane;

a waterway sloping downwardly from an upper inlet which is fluidly connected to said tank, to a lower exit entering said bowl near said well, said waterway supplying water from said tank to said bowl, from said lower exit;

said upper inlet, said well and said discharge outlet all being intersected by said reference plane;

said trap being angled with respect to said reference plane;

said well being canted with respect to said reference plane vertically downwardly in a forward and lateral direction, such that distinct high and low points of said well are defined, said distinct high and low points being laterally spaced on opposite sides of said reference plane; and said lower exit having an open notch, said notch being adjacent to said high point and extending from a position vertically lower than said high point to a position vertically higher than said high point to supply water into said bowl vertically above said well, a groove communicating with said lower exit at a position vertically below said well near said high point, said groove extending below said well, to communicate water from said waterway into said trap at a position generally vertically aligned with, and below said low point, such that water exiting said notch creates a vortex in said bowl, and water exiting said groove creates a second vortex in said trap.

4. A toilet comprising:

a tank;

a trap having a discharge outlet at a downstream end for connection with a drain pipe;

a bowl having a large top opening and a small well at a bottom leading into said trap;

a waterway sloping downwardly from an upper inlet fluidly connected to said tank, to a lower exit, which enters said bowl near said well;

said well defining a planar opening and having a distinct low point and a distinct high point, said lower exit having an open notch, with said notch being adjacent to said high point, and extending from a position vertically lower than said high point to a position vertically higher than said high point, to supply water from said waterway into said bowl at a position vertically above said well;

a groove communicating with said lower exit at a position near said high point, and vertically below said well, said groove extending below said well to communicate water from said waterway into said trap at a position generally vertically aligned with, and below said low point of said well, such that water exiting said notch creates a vortex in said bowl, and water exiting said groove creates a second vortex in said trap.

5. A toilet as recited in claim 4, wherein said bowl being positioned longitudinally forwardly of said tank, a longitudinally and vertically extending plane which bisects said bowl being defined as a reference plane, said notch directing water laterally outwardly into said bowl at an angle away from said reference plane.

6. A toilet as recited in claim 5, wherein said well being canted with respect to said reference plane such that it is tilted vertically downwardly in a forward and lateral direction, said low and high points of said well being laterally displaced on opposite sides of said reference plane.

7. A toilet comprising:

a tank;

a trap having a discharge outlet at a downstream end for connection with a drain pipe;

a bowl having a large top opening and a small well at a bottom leading into said trap;

a waterway sloping downwardly from an upper inlet fluidly connected to said tank, to a lower exit, which enters said bowl near said well;

said well defining a planar opening and having a distinct low point and a distinct high point, said lower exit having an open notch, with said notch extending from said well to a position above said well to supply water from said waterway into said bowl, at a position vertically above said well;

a groove communicating with said lower exit at a position near said high point, and vertically below said well, said groove extending below said well to communicate water from said waterway into said trap at a position generally vertically aligned with, and below said low point of said well, such that water exiting said notch creates a vortex in said bowl, and water exiting said groove creates a second vortex in said trap.

* * * * *